United States Patent [19]

Wilson

[11] 4,020,858

[45] May 3, 1977

[54] SAFETY UMBRELLA

[76] Inventor: Inez F. Wilson, 1830 Lexington Ave., Apt. 1A, New York, N.Y. 10029

[22] Filed: Mar. 22, 1976

[21] Appl. No.: 669,144

[52] U.S. Cl. ..... 135/20 R; 135/66; 135/DIG. 10; 240/6.42

[51] Int. Cl.[2] ..... A45B 3/02

[58] Field of Search ..... 135/DIG. 10, 47, 66, 135/20 R; 240/6.42

[56] References Cited

UNITED STATES PATENTS

| | | | |
|---|---|---|---|
| 1,659,346 | 2/1928 | Beatty | 240/6.42 |
| 1,707,473 | 4/1929 | Goldberg | 240/6.42 |
| 1,795,268 | 3/1931 | Thomases | 135/DIG. 10 X |
| 2,104,340 | 1/1938 | Carmody | 135/DIG. 10 X |
| 2,235,864 | 3/1941 | Brennan et al. | 135/DIG. 10 X |
| 2,372,471 | 3/1945 | Campbell | 240/6.42 |
| 2,507,919 | 5/1950 | Mazzeo | 135/DIG. 10 X |
| 2,889,449 | 6/1959 | Faloon | 240/6.42 |
| 3,777,136 | 12/1973 | Okuda | 240/6.42 |

*Primary Examiner*—Werner H. Schroeder
*Assistant Examiner*—Conrad L. Berman
*Attorney, Agent, or Firm*—Richard L. Miller

[57] ABSTRACT

An umbrella including a foldable canopy supported from one end of a shaft which at its other end has a handle, the umbrella being novel by including an electric lamp upon its tip so that, among other uses, the present of a person crossing a street during rainy and obscure weather can be readily visible to motorists; the umbrella including an electric switch and dry cell batteries for the lamp carried inside the handle.

1 Claim, 7 Drawing Figures

SAFETY UMBRELLA

This invention relates generally to umbrellas such as are used to protect a person from falling rain.

A principal object of the present invention is to provide a safety umbrella which additionally includes an illuminating lamp upon its tip so that the presence of a person can be readily seen when a rainy weather is obscure by a heavy downpour or accompanied by darkness or fog.

Another object is to provide a safety umbrella which accordingly will permit motorists to more easily see a pedestrian crossing a street so as to avoid running run him over.

Yet another object is to provide a safety umbrella which accordingly, will permit pedestrians on crowded city sidewalks to see each other so to not collide.

Yet another object is to provide a safety umbrella which can furnish sufficient illumination to light a path for walking or which can be used as a flashlight to identify addresses or names of mailboxes as well as illuminating key holes in dark areas for insertion of a key.

Other objects are to provide a safety umbrella which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
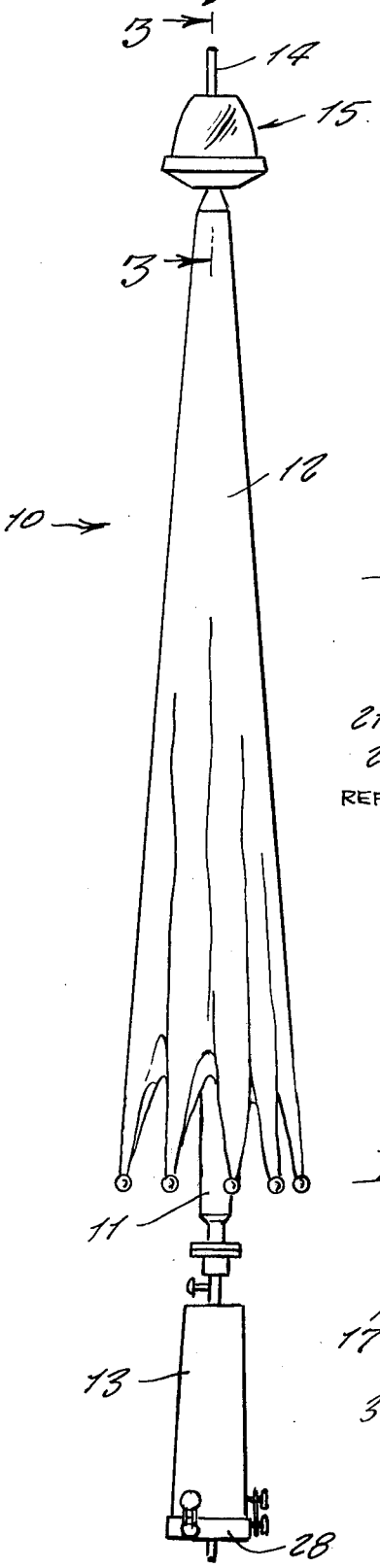
FIG. 1 is a side view of the umbrella shown closed.
Figure 2:
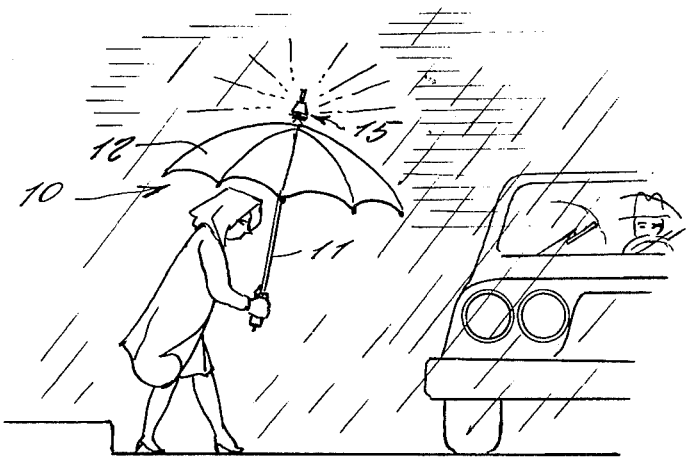
FIG. 2 shows it opened and in use by a person crossing a street in front of stopped cars at a traffic light.
Figure 3:
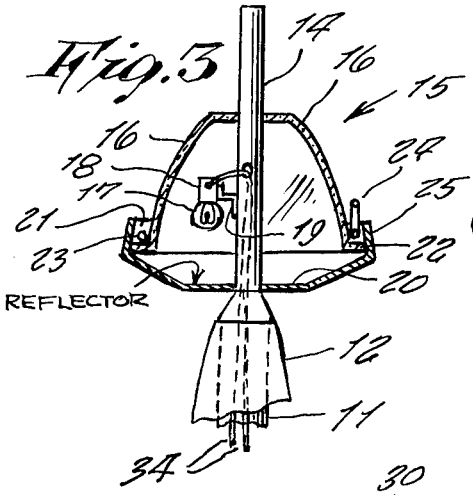
FIG. 3 is an enlarged cross section on line 3—3 of FIG. 1.
Figure 4:
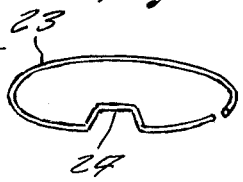
FIG. 4 is a perspective view of a snap ring shown in FIG. 3.

Referring now to the drawing in detail, the numeral 10 represents a safety umbrella according to the present invention wherein the same includes an elongated shaft 11 which at one end supports a foldable framework (not shown) carrying a canopy 12. The other end of the shaft has a handle 13 for being held in a person's hand.

In the present invention, a protruding tip 14 of the shaft has a lamp 15 mounted thereupon and includes a transparent dome 16 enclosing an electric lamp bulb 17 filled in socket 18 mounted on a bracket 19 secured to a side of the protruding tip 14. A reflector 20 forms a rear of the lamp so to direct light rays from the bulb outwardly through the dome. The dome may be made either colorless or tinted red so to reflect red light rays.

The edge of the reflector has a channel 21 into which a flanged edge 22 of the dome fits and is retained by means of a wire snap ring 23. The snap ring includes a U-shaped bend 24 which extends outwardly of the channel for easy grasp for removal of the snap ring from falling out.

Figure 5:
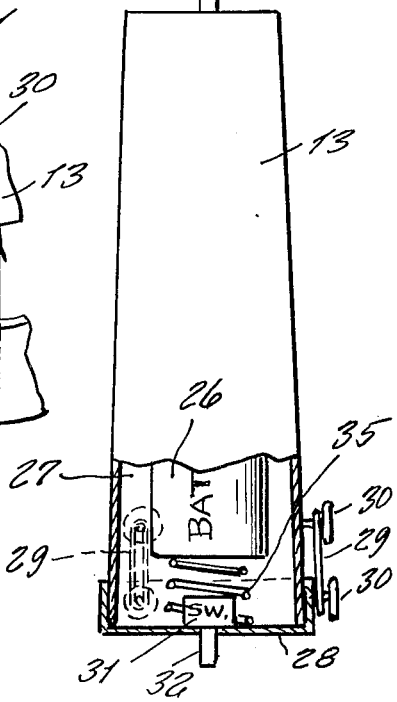
FIG. 5 is a side view of the handle shown partly in cross section.
Figure 6:
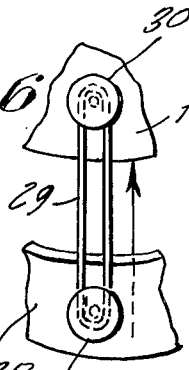
FIG. 6 is a detail thereof.
Figure 7:
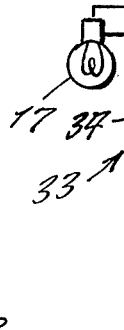
FIG. 7 is an electric circuit of the invention.

Electric power for the bulb 17 is supplied by dry cell batteries 26 contained in a hollow chamber 27 formed inside the handle 13; the batteries being replacable by removal of a cap 28 upon the end of the handle; the cap 28 upon the end of the handle; the cap being normally retained on the handle by means of elastic or rubber bands 29 fitted around buttons 30. An electric switch 31 supported inside the cap 28 has a protruding switch button 32 so to open or close an electric circuit 33 between the bulb and batteries. Connection between the bulb and the switch and batteries is made by wire conductors 34 that extend inside the shaft 11 which is made tubular. Thus all wiring is enclosed. As shown in FIG. 5, the switch is seated inside the compression coil spring 35 that pushes the batteries into contact with a battery terminal plate (not shown) of the circuit in a well known manner.

In operative use, it is now evident that when a person carrying the umbrella wishes to use the light, he needs only to flip the convenient switch button on the handle.

Thus an improved umbrella is provided.

While certain novel features of this invention have been shown and described and are pointed out in the annexed claims, it will be understood that various omissions, substitutions, and changes in the forms and details of the device illustrated and in its operation can be made by those skilled in the art without departing from the spirit of the invention.

What is claimed is:

1. A safety umbrella, comprising in combination, a tubular shaft supporting a foldable framework at its one end, a canopy mounted upon said framework, a hollow handle upon an opposite end of said shaft for being held in a hand, the first said end of said shaft having an integral tip thereof protruding through a center opening of said canopy, an electric lamp mounted around a base end of said tip; said lamp including a Z-shaped bracket secured to a side of said shaft tip, a lamp socket mounted on said bracket, an electric lamp bulb in said socket, said lamp bulb being in a series electrical circuit that includes dry cell batteries and a manually operated switch inside said handle; said circuit including wire conductors inserted inside said tubular shaft, and opening in said shaft located near said bracket having said wire conductors extend outwardly therethrough and being connected to said socket, said shaft tip being diametrically smaller than a remainder of said shaft, a tapering shoulder thus formed adjacent said base end of said tip, a dish-shaped circular reflector, having a central opening, being fitted on said tip and positioned adjacent said shoulder, said reflector having a reflective surface on a concave side thereof facing said lamp bulb, said reflector including a circular peripheral flange extending frusto-conically tapered toward an edge of said flange thus forming a circular channel into which an outwardly flanged edge of a transparent dome is received an open-ended circular wire snap ring received in said channel over said dome flange, said snap ring retaining said dome in said channel, a U-shaped bend along said snap ring extending outwardly of said channel for easy grasp for removal of said snap ring from said channel, said dome having a central opening for fitting a terminal end of said shaft tip therethrough, an opposite end of said wire conductors being connected to said batteries and said switch, said hollow handle having an opening on its terminal end, a removable end cap frictionally fitted on said handle end closing said opening, a row of buttons around an outer side of said handle and another row of buttons around an outer side of said end cap, each said buttons of said handle aligning with of a button of said end cap, a rubber band snapped around each pair of said aligned buttons, said switch being mounted upon an inner side of said end cap, a switch button of said switch extending outwardly through said end cap, and a compression coil spring around said switch bearing at one end against said end cap and bearing at the other end against an end wall of one said batteries said spring urging an opposite end of an opposite endmost battery with a battery terminal plate thus completing said circuit through said spring.

* * * * *